United States Patent [19]

Madden

[11] 4,195,674

[45] Apr. 1, 1980

[54] PROTECTIVE HOOD FOR A VAPOR RECOVERY NOZZLE

[75] Inventor: Michael J. Madden, Long Beach, Calif.

[73] Assignee: Pacific Oil Marketing Equipment Company, Paramount, Calif.

[21] Appl. No.: 878,004

[22] Filed: Feb. 15, 1978

[51] Int. Cl.[2] ..... B65B 3/00; B67D 5/12

[52] U.S. Cl. ..... 141/392; 222/74; 248/75

[58] Field of Search ..... 5/113; 135/5 E; 141/1, 141/98, 392, 59; 137/355.16; 222/74, 538; 312/285; 248/75; D15/7; D52/2 A

[56] References Cited

U.S. PATENT DOCUMENTS

| | | | |
|---|---|---|---|
| 2,115,303 | 4/1938 | Dayton | 222/74 X |
| 2,405,264 | 8/1946 | Marvel | 222/74 |
| 2,900,111 | 8/1959 | Scheurer | 222/74 |
| 4,018,252 | 4/1977 | Burtis et al. | 141/59 X |

*Primary Examiner*—Frederick R. Schmidt
*Attorney, Agent, or Firm*—Phillips, Moore, Weissenberger, Lempio & Majestic

[57] ABSTRACT

A gasoline pump comprises a housing having a vapor recovery nozzle mounted on a bracket. An actuating lever is pivotally mounted on the housing for movement between "on" and "off" positions. The nozzle comprises an annular elastomeric face seal adapted for sealing engagement over a fill neck of a vehicle and a spout extending through the face seal for disposition within the fill neck for gasoline filling purposes. A hood assembly is secured on the housing to cooperate with the bracket to mount the nozzle and to fully enclose and protect the face seal thereof. The hood assembly preferably comprises a metallic plate secured to the housing of the pump and a generally wedge-shaped hood member secured to the plate. An elastomeric gasket is secured to the lower free edges of the hood member to prevent damage to the face seal of the vapor recovery nozzle upon insertion thereof into the hood assembly. The bracket may be mounted on the housing, on the actuating lever or, on the hood assembly. The pump is arranged so that the nozzle cannot be mounted on the bracket to dispose the stem thereof within the hood assembly, unless the actuating lever is pivoted to its "off" position.

21 Claims, 6 Drawing Figures

FIGURE 4.
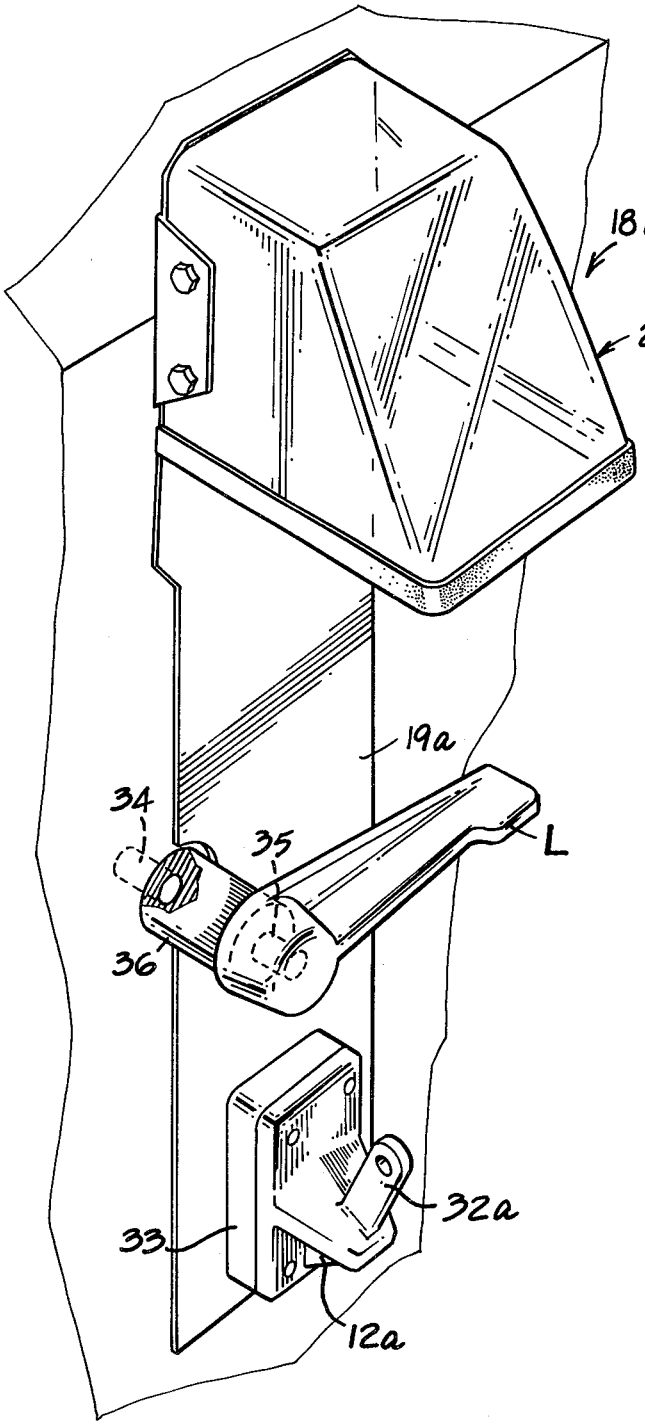
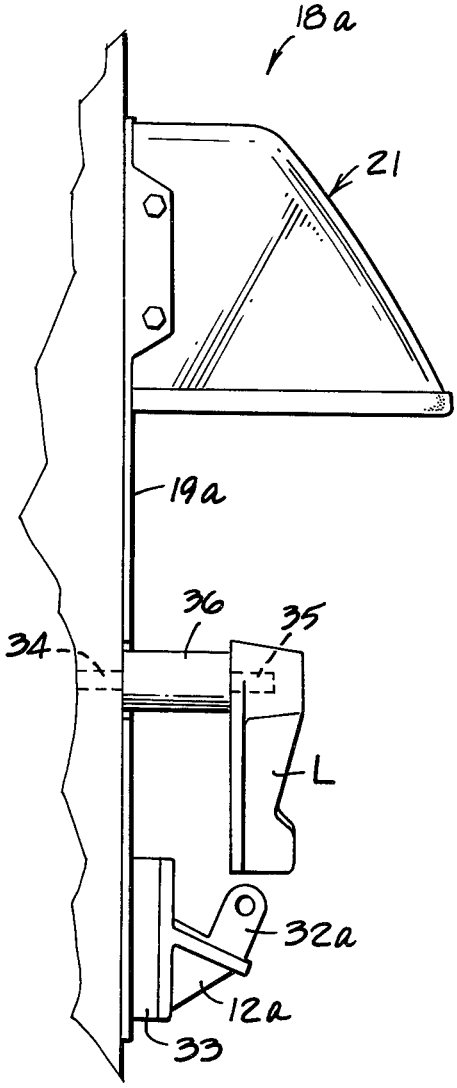
FIGURE 5.

PROTECTIVE HOOD FOR A VAPOR RECOVERY NOZZLE

BACKGROUND OF THE INVENTION

This invention relates to a hood assembly and mounting arrangement for mounting a vapor recovery nozzle on a gasoline pump and to fully protect the face seal thereof, including means for assuring movement of a gasoline-supplying actuating lever to its "off" position prior to the mounting of the nozzle on the pump.

The advent of vapor recovery nozzles for environmental protection purposes has given rise to a number of problems. One such problem involves the forming of a tight seal at the entry mouth of a fill neck of a vehicle to prevent gasoline vapors from escaping to the atmosphere upon filling of a gasoline tank. The face seal is formed of an elastomeric material and is normally connected to a bellows whereby the sealing function may be readily achieved.

Upon mounting of the oversized vapor recovery nozzle on a gasoline pump, which oftentimes proves difficult, the handle thereof is normally mounted on a bracket secured to a side of the pump and the spout normally extends within an opening also formed on a side of the pump and above the bracket. Such mounting inherently contacts the face seal of the nozzle with the pump housing to cause scuffing thereof whereby the sealing capability of the face seal is impaired. In addition, the face seal and bellows are unprotected and subjected to damage when mounted on the pump. Also, the mounted nozzle can inadvertently fall-off the pump to cause further damage to the face seal and bellows.

Furthermore, various governmental agencies, e.g., Bureau of Weights and Measures, require that an actuating lever for selectively supplying gasoline through the nozzle must be moved to its "off" position upon completion of a particular filling operation. This requirement is primarily for the benefit of a second customer who might be charged for the first customer's gasoline supply.

SUMMARY OF THE INVENTION

An object of this invention is to overcome the above, briefly described problems by providing a hood means and mounting arrangement for mounting a vapor recovery nozzle on a gasoline pump and to fully enclose and protect a face seal of the nozzle. Means, including a mounting bracket which cooperates with the hood means to mount the nozzle, are provided to assure that an actuating lever for supplying gasoline is in its "off" position prior to mounting of the nozzle on the pump.

BRIEF DESCRIPTION OF THE DRAWINGS

Other objects of this invention will become apparent from the following description and the accompanying drawings wherein:

FIG. 4 is a front and partially exploded isometric view of a modified hood assembly and mounting arrangement;

FIG. 5 is a side elevational view of the FIG. 4 hood assembly and mounting arrangement.

DETAILED DESCRIPTION OF THE PREFERRED EMBODIMENT

Figure 1:
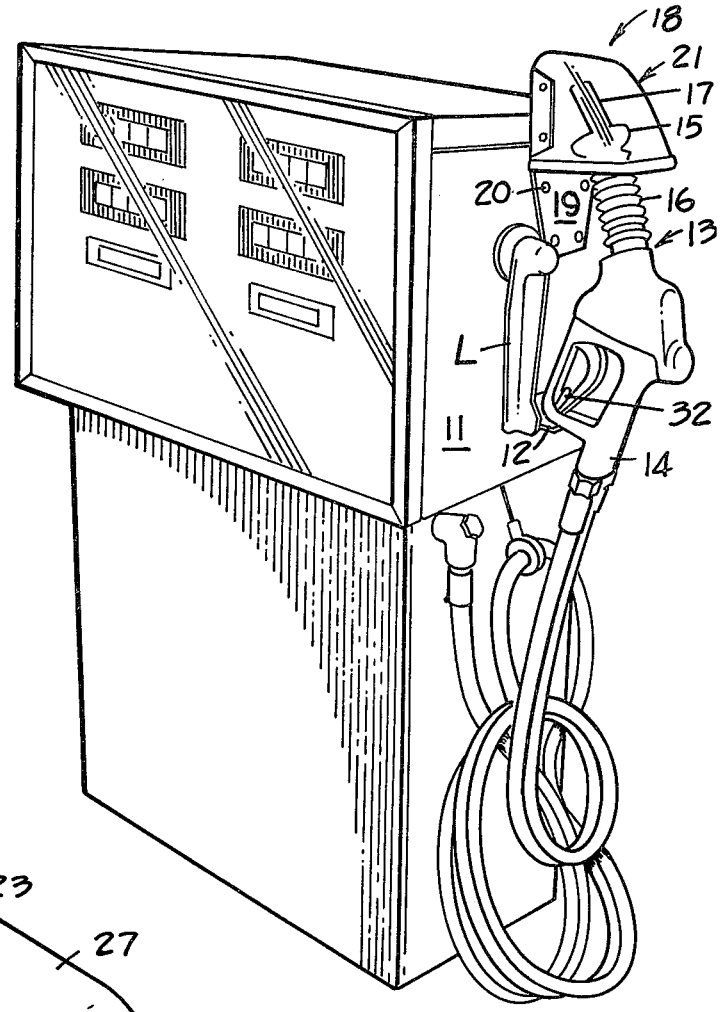
FIG. 1 is an isometic view illustrating a gasoline pump having a vapor recovery nozzle mounted on a side thereof and a hood assembly and mounting arrangement of this invention on the pump to mount and fully protect a face seal of tne nozzle.

FIG. 1 illustrates the gasoline pump 10 comprising a housing 11, having a gasoline-supplying actuating lever L pivotally mounted on a side thereof. It should be understood that the term "pump" as used herein can mean either a device wherein housing 11 has a positive displacement pump mounted therein or a dispenser wherein such pump is mounted externally of the housing. A vapor recovery nozzle 13 includes a handle 14, removably mounted on a bracket 12, secured on a lower end of lever L. The nozzle further comprises an annular elastomeric face seal 15 adapted for sealing engagement over the mouth of a fill neck of a vehicle upon filling of a gasoline tank when lever L is pivoted counterclockwise to a horizontal "on" position. The vapor recovery nozzle also comprises an elastomeric bellows 16 having the face seal secured on an end thereof and a spout 17 having an end portion thereof extending through the face seal and bellows for disposition within the fill neck of the vehicle for filling purposes.

Figure 2:
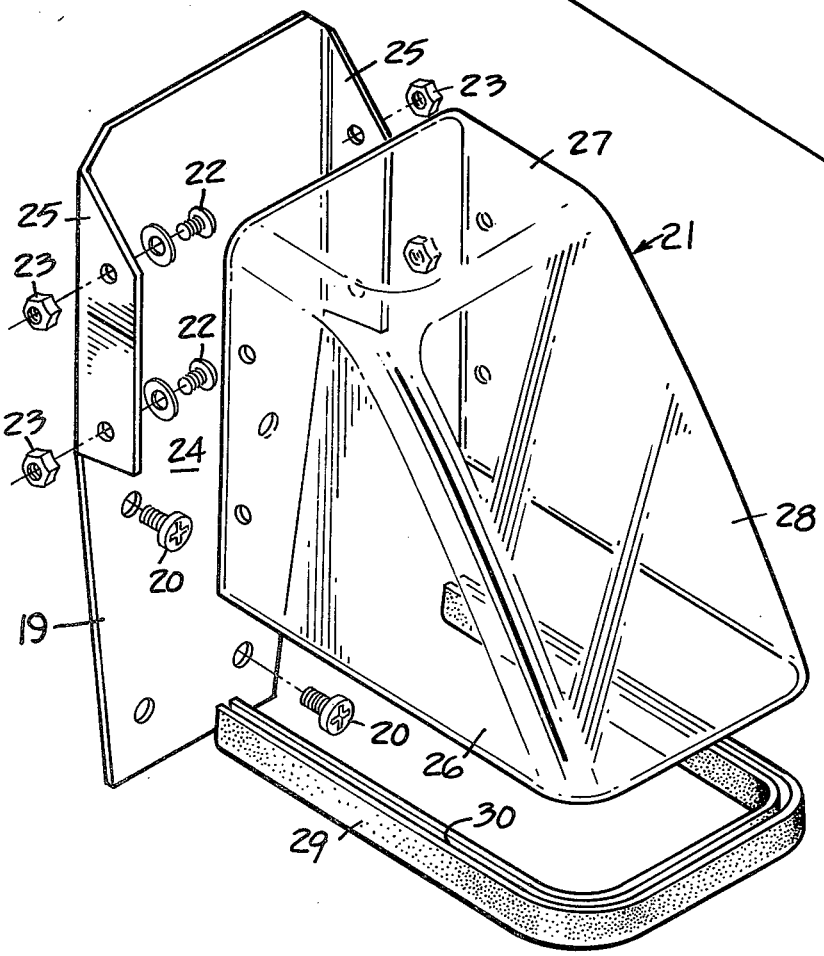
FIG. 2 is an enlarged and exploded isometric view of the hood assembly.

A hood means 18 is secured on housing 11 of the gasoline pump, vertically above bracket 12, for fully enclosing and protecting face seal 15, at least a portion of bellows 16 and the exposed end portion of spout 17. The hood means further functions to cooperate with means, including bracket 12, to only permit mounting of the nozzle on the pump when lever L is disposed in its illustrated vertically disposed "off" position. Referring to FIGS. 1 and 2, the hood means comprises a metallic plate member 19 secured to pump housing 11 by a plurality of fastening means or cap screws 20 and a generally wedge-shaped hood member 21 secured to the plate by a plurality of fastening means, such as screws 22 and lock nuts 23 (FIG. 2). Plate member 19 comprises a flat plate 24 having a pair of laterally spaced and upstanding flanges 25 formed on upper edges thereof. The lower portion of the plate is thus entirely flat and free of flanges to permit unobstructed insertion of vapor recovery nozzle 13 into the hood member.

Hood member 21 may be composed of a clear and transparent plastic material to visually indicate the disposition of the vapor recovery nozzle in the hood to the station attendant. Alternatively, the hood member may be composed of a metallic material, such as aluminum or sheet metal. The hood member comprises a pair of vertically disposed and laterally spaced side walls 26, an upper wall 27 and a front wall 28 which diverges downwardly and outwardly relative to the upper wall. A U-shaped elastomeric sealing gasket 29 defines a channel 30 therein which mounts on the lower free edges of walls 26-28 of the hood member. The gasket may be secured in place on the hood member by means of a standard adhesive and functions to prevent damage to seal 15 when the nozzle is mounted on the pump.

Figure 3:
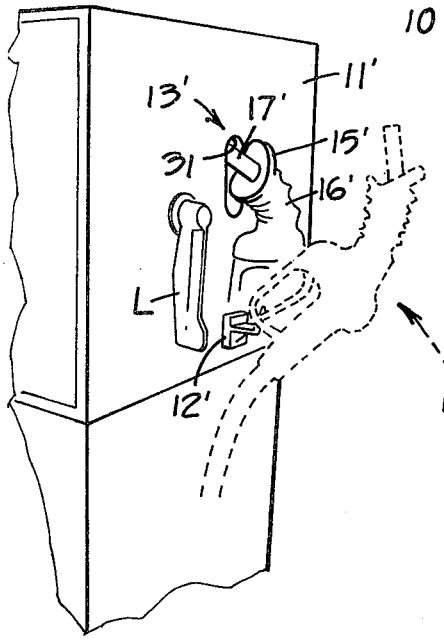
FIG. 3 illustrates a conventional mounting for a vapor recovery nozzle on a gasoline pump.

FIG. 3 illustrates a conventional mounting for a vapor recovery nozzle 13' wherein a handle thereof is mounted on a bracket 12, secured to a side of a housing 11' of the pump. An elongated slot 31 is formed through a side wall of the housing and a spout 17' of the nozzle is disposed within the slot. A face seal 15' and a bellows 16' tend to squash against the housing whereby permanent deformation, scuffing or other damage may be occasioned thereto. The damage to the face seal is further aggravated by its engagement with damaged areas of the pump housing in the vicinity of slot 31 due to engagement therewith by the end of spout 17'.

Such damage to the face seal will, of course, adversely affect the intended sealing function of the face seal whereby gasoline vapors, as well as liquid gasoline, are permitted to escape to ambient. Furthermore, the nozzle remains fully unprotected in its stored position and may tend to fall-off the pump to its 13'' position and, in fact, drop onto the cement foundation for the gasoline pump. The problem of positively mounting nozzle 13' on the gas pump is further aggravated since the latest models of the vapor recovery nozzle are bulky and have their spouts lengthened over prior spouts by approximately two inches.

Another problem exists with such a standard mounting arrangement for the nozzle. In particular, governmental regulations (Bureau of Weights and Measures) now require that an actuating lever L for supplying gasoline through the nozzle be returned to its illustrated "off" position (from a pivoted and horizontally disposed "on" position) after a customer's gasoline tank has been filled.

As mentioned above, hood assembly 18 and means associated therewith for mounting nozzle 13 on pump 10 overcome such problems by: (1) Fully protecting face seal 15 and the upper portion of bellows 16; (2) preventing inadvertent displacement of vapor recovery nozzle 13 from its mounted position on gasoline pump 10; and (3) preventing mounting of the nozzle on the pump, unless lever L has been returned to its illustrated "off" position in FIG. 1. In particular, after a vehicle has been serviced and the lever has been returned to its "off" position, the attendant need merely insert the upper end of nozzle 13 within the lower, open end of hood assembly 18 and engage a slot formed through handle 14 on a lug 32 of mounting bracket 12.

The weight of the nozzle may tend to pivot the nozzle away from the pump to a substantially vertical position whereby only minimal light pressure contact, if any, occurs between face seal 15 and the hood member. Furthermore, outward pivoting of the nozzle is prevented since hood member 21 functions as a stop means for preventing inadvertent dislodgement of the nozzle from the gas pump. It should be further noted that should the service attendant inadvertently leave lever L in its horizontally disposed "on" position (pivoted counterclockwise from its illustrated vertical position in FIG. 1) that the attendant will be unable to mount handle 14 of the nozzle on bracket 12 which is secured to the lever. Thus, a fail-proof mounting arrangement is provided which will assure that a subsequent customer will not be charged for the gasoline supplied to a previous customer.

FIGS. 4 and 5 illustrate a modification of the hood means and mounting arrangement for nozzle 13 wherein identical numerals are employed to depict corresponding constructions, but with numerals appearing in FIGS. 4 and 5 which depict modified constructions being accompanied by an "a." Such hood means and mounting arrangement are adapted for use on a different type of gasoline pump than the type of pump which is adapted to utilize the FIGS. 1 and 2 arrangement.

In particular, a hood means **18*a* comprises a modified plate member 19*a* having hood 21 secured on an upper end thereof. A mounting bracket 12*a* is secured on the plate member along with a spacer means or block 33 which precisely positions a hook 32*a*, adapted to mount handle 14 of vapor recovery nozzle 13 thereon (FIG. 1), at a predetermined distance from the pump's housing. A pivot shaft 34 is pivotally mounted on the pump in a conventional manner to selectively actuate a flow control valve to communicate gasoline to the nozzle upon pivoting of lever L counterclockwise to a horizontally disposed position in FIG. 4**.

The lever is suitably secured on a pin 35 of a tubular adapter 36 having an end thereof secured to shaft 34. As shown in FIG. 5, sufficient clearance is provided between hook **32*a* and the lever to permit the lever to be pivoted to its "on" or horizontal position. In such a position, it should be noted that the attendant is unable to mount handle 14 of nozzle 13 (FIG. 1) on lug 32*a* since adapter 36 has positioned lever L sufficiently outwardly from plate member 19*a* to form an obstruction to such mounting. Thus, means including bracket 12*a*, adapter 36 and lever L are provided for permitting mounting of the nozzle on bracket 12*a* and disposition of spout 17 of the nozzle within hood 21 only when lever L is maintained in its vertically disposed "off" position illustrated in FIGS. 4 and 5. In addition, when the nozzle is mounted on the pump, hood 21 will function to fully enclose and protect face seal 15** and adjacent parts of the nozzle.

Figure 6:
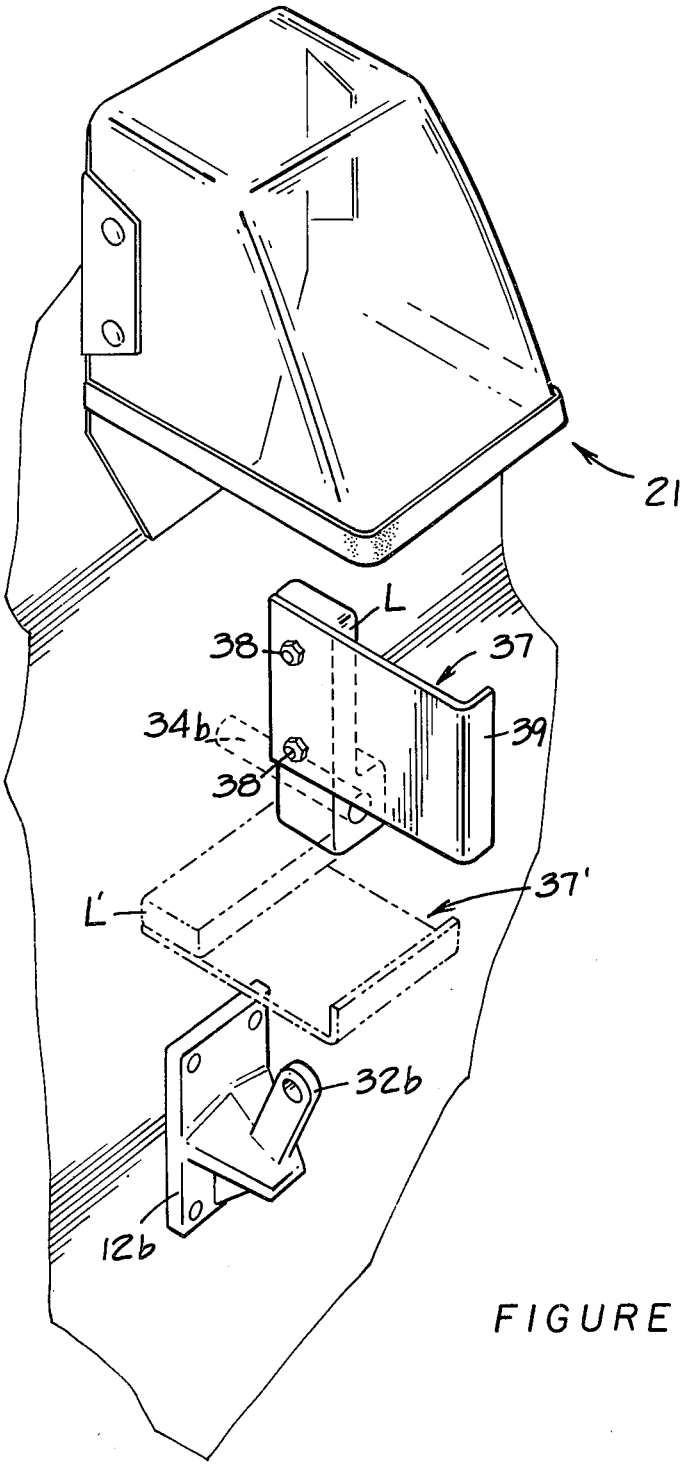
FIG. 6 is a front isometric view illustrating a further modification of the mounting arrangement.

FIG. 6 illustrates a further modification of the mounting arrangement (the FIGS. 1 and 2 hood means 18 is used therewith) wherein identical numerals depict corresponding constructions, but wherein numerals depicting modified constructions in FIG. 6 are accompanied by a "b."

In FIG. 6, the mounting arrangement for nozzle 13 (FIG. 1) has been modified to adapt it to yet a different type of gasoline pump. In particular, a mounting bracket **12*b* is secured directly to the side of a housing of the pump and has a lug 32*b* secured thereon and adapted to mount handle 14 of the nozzle thereon. Actuating lever L for selectively communicating gasoline to the nozzle is adapted to be pivoted in a clockwise direction from its solid line "off" position to its horizontally disposed and phantom-lined "on" position L'. A bracket 37 in the form of a plate is suitably secured to the lever by a pair of cap screws 38. A rounded flange portion 39** is formed on the end of the plate for purposes hereinafter explained.

When lever L is disposed in its "off" position, the attendant is able to mount nozzle 13 (FIG. 1) within hood 21 and on mounting bracket **12*b*. However, when the lever is pivoted to its "on" position, bracket 37 is disposed in obstructing relationship beneath the hood to prevent mounting of the nozzle on the pump, i.e., handle 14 cannot be mounted on lug 32*b* and simultaneously dispose spout 17 of the nozzle within hood 21 (FIG. 1). Furthermore, it should be noted that flange portion 39 provides a substantially smooth and nonsharp surface to prevent any damage to seal 15 or bellows 16 of the nozzle should the attendant inadvertently attempt to mount the same within the hood and on mounting bracket 12*b***.

It can be seen from the above description that the hood means and associated mounting arrangements all have the common purpose and functions of: (1) Fully protecting face seal 15 and the upper portion of bellows 16 of nozzle 13; (2) preventing inadvertent displacement of the nozzle from its mounted position on the gasoline pump; and (3) preventing mounting of the nozzle on the pump unless the respective actuating lever for supplying gasoline to the nozzle has been returned to its "off" position. It should be further noted that the novel hood means and mounting arrangement of this invention are adapted for use on a wide variety of standard gasoline pumps without having to drastically modify the pumps.

I claim:

1. A pump comprising a housing an actuating lever movably mounted on said housing for movement between "on" and "off" positions, a vapor recovery nozzle including a handle, an annular elastomeric face seal adapted to sealingly engage over a fill neck of a vehicle and a spout having an end portion extending through said face seal for disposition within said fill neck for filling purposes, hood means secured exteriorly on said housing and independent thereof and defining an opening at a lower end thereof positioned to receive said spout therein for fully enclosing and protecting said face seal, and means, including a mounting bracket secured on one of said housing, said lever and said hood means and adapted to have the handle of said nozzle removably mounted thereon, for only permitting mounting of said handle on said mounting bracket and disposition of said spout within said hood means exteriorly of said housing when said lever is maintained in its "off" position on said housing, said hood means extending outwardly from said housing in overlying relationship relative to said mounting bracket.

2. The pump of claim 1 wherein said hood means comprising a plate member secured to said housing and a hood member secured to said plate member.

3. The pump of claim 2 wherein said plate member comprises a pair of laterally spaced flanges formed on upper edges thereof and fastening means securing said hood member to said flanges.

4. The pump of claim 3 wherein a lower portion of said plate member, below said flanges, is entirely flat and unobstructed.

5. The pump of claim 2 wherein said hood member is generally wedge-shaped to comprise a pair of vertically disposed and laterally spaced side walls, an upper wall secured between said side walls and a front wall secured between said side and top walls, said front wall disposed to diverge forwardly and away from said top wall.

6. The pump of claim 5 further comprising a U-shaped elastomeric gasket secured to lower free edges of said side, upper and front walls.

7. The pump of claim 2 wherein said hood member is composed of a transparent material for permitting visual inspection of said face seal by an attendant.

8. The pump of claim 2 wherein said mounting bracket is secured on said plate member and is disposed vertically below said hood member.

9. The pump of claim 1 wherein said mounting bracket is secured on said lever.

10. The pump of claim 1 wherein said mounting bracket is secured directly on said housing and is disposed vertically below said hood means.

11. The pump of claim 1 wherein said mounting bracket is disposed vertically below said hood means and further comprising spacer means secured to said lever for disposing said lever outwardly from said housing at a predetermined distance and for permitting said lever to be moved from a vertically disposed "off" position to a horizontally disposed "on" position between said hood means and said mounting bracket for obstructing the area therebetween to prevent mounting of said nozzle on said mounting bracket and at least partially within said hood means.

12. The pump of claim 1 wherein said mounting bracket is disposed vertically below said hood means and further comprising obstruction means secured to said lever for permitting said nozzle to be mounted on said mounting bracket and at least partially within said hood means when said lever is maintained in a vertically disposed "off" position and for preventing said nozzle to be so mounted when said lever is maintained in a horizontally disposed "on" position.

13. The pump of claim 12 wherein said obstruction means comprises a plate secured to said lever.

14. The pump of claim 13 wherein said plate has an upturned flange means formed on an end thereof for preventing damage to the face seal of said nozzle upon an attempt to mount said nozzle on said pump when said lever is maintained in its "on" position.

15. A hood assembly in kit form for mounting on a housing of a gasoline pump for fully enclosing and protecting a face seal of a vapor recovery nozzle comprising plate means for securance to the housing of said gasoline pump, means defining holes through said plate means for receiving fasteners therethrough for securing said plate means to said housing, a hood member secured to said plate means and defining an opening at a lower end thereof adapted to receive an upper portion of said vapor recovery nozzle, including its face seal, therein, and adapted to extend outwardly from said housing in overlying relationship relative to a mounting bracket for said vapor recovery nozzle, and a U-shaped elastomeric gasket secured to lower free edges of said hood member for preventing damage to the face seal of said vapor recovery nozzle when said nozzle is mounted on said pump.

16. The hood assembly of claim 15 wherein said plate means comrises a pair of laterally spaced flanges formed on upper edges thereof and fastening means securing said hood member to said flanges.

17. The hood assembly of claim 16 wherein a lower portion of said plate means, below said flanges, is entirely flat and unobstructed.

18. The hood assembly of claim 15 wherein said hood member is generally wedge-shaped to comprise a pair of vertically disposed and laterally spaced side walls, an upper wall secured between said side walls and a front wall secured between said side and top walls, said front wall disposed to diverge forwardly and away from said top wall and wherein said gasket is secured to lower, free edges of said side and front walls.

19. The hood assembly of claim 15 wherein said hood member is composed of a tranparent plastic material.

20. The hood assembly of claim 15 wherein said hood member is composed of an opaque metallic material.

21. The hood assembly of claim 15 further comprising a mounting bracket secured on said plate means and disposed vertically below said hood member for mounting a handle of said vapor recovery nozzle thereon.

* * * * *

UNITED STATES PATENT OFFICE

CERTIFICATE OF CORRECTION

Patent No. 4,195,674 Dated April 1, 1980

Inventor(s) Michael J. Madden

It is certified that error appears in the above-identified patent and that said Letters Patent are hereby corrected as shown below:

On the Title Page;
Inventor's residence, please change "Long Beach" to --West Covina--.

Column 5, line 37, please change "comprising" to --comprises--.

Column 6, line 46, please change "comrises" to --comprises--.

Signed and Sealed this

*Eighth* Day of *July 1980*

[SEAL]

*Attest:*

SIDNEY A. DIAMOND

*Attesting Officer*

*Commissioner of Patents and Trademarks*